US006592949B1

(12) United States Patent
Polke et al.

(10) Patent No.: US 6,592,949 B1
(45) Date of Patent: Jul. 15, 2003

(54) MARKING PLASTICS SURFACES

(75) Inventors: Reinhard Polke, Mutterstadt (DE); Michael Schäfer, Altrip (DE); Martin Welz, Bad Dürkheim (DE); Manfred Reimann, Drensteinfurt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/708,026

(22) Filed: Nov. 8, 2000

(30) Foreign Application Priority Data

Nov. 11, 1999 (DE) ..... 199 54 366

(51) Int. Cl.[7] ..... B05D 3/06; B05D 5/06

(52) U.S. Cl. ..... 427/553; 427/256; 427/282; 427/286; 427/487; 427/492; 427/508; 427/510; 427/511; 427/514; 427/554; 427/555; 427/558; 427/596; 427/400; 427/346; 427/372.2; 427/375; 427/384; 427/385.5; 427/393.5; 427/553

(58) Field of Search ..... 427/256, 282, 427/286, 487, 492, 508, 510, 511, 514, 553–554, 555, 558, 596, 400, 346, 372.2, 375, 384, 385.5, 393.5

(56) References Cited

U.S. PATENT DOCUMENTS

| | | | | | |
|---|---|---|---|---|---|
| 4,042,476 | A | * | 8/1977 | Collins et al. | 204/159.15 |
| 4,844,947 | A | * | 7/1989 | Kasner et al. | 427/53.1 |
| 4,975,300 | A | * | 12/1990 | Deviny | 427/54.1 |
| 4,990,364 | A | * | 2/1991 | Bolte et al. | 427/385.5 |
| 5,543,177 | A | * | 8/1996 | Morrison et al. | 101/491 |
| 6,001,428 | A | * | 12/1999 | Finter et al. | 427/485 |
| 6,210,472 | B1 | * | 4/2001 | Kwan et al. | 106/31.14 |
| 6,224,205 | B1 | * | 5/2001 | Akahira et al. | 347/107 |
| 6,277,937 | B1 | * | 8/2001 | Duvalsaint et al. | 526/255 |
| 6,406,757 | B1 | * | 6/2002 | Blatter et al. | 427/195 |

* cited by examiner

*Primary Examiner*—Shrive P. Beck
*Assistant Examiner*—Jennifer Kolb Michener
(74) *Attorney, Agent, or Firm*—Keil & Weinkauf

(57) ABSTRACT

A method of marking a plastics surface comprises at least the following steps:

a) applying a composition comprising at least one coloring component to a plastics surface, b) irradiating the plastics surface with light from a light source.

11 Claims, No Drawings

MARKING PLASTICS SURFACES

The invention relates to a method of marking plastics surfaces, especially with plastics-based compositions.

It is known to mark metal, glass and ceramic surfaces using mixtures comprising a temperature-resistant chromophore and finely ground glass. This mixture is first applied to the surface in question. The surface is then heated locally, i.e., at every point where marking is to take place and the mixture has been applied beforehand, using a laser of appropriate wavelength, in a very short time, until the melting point of the ground glass is reached. The chromophores, usually solid inorganic pigment particles having a diameter of approximately 10 $\mu$m, absorb the incident radiation without themselves melting, the surrounding glass mass melting as a result of the absorption of energy by the pigments themselves. The resulting melt then bonds locally with the surface in question and forms a continuous, abrasion-resistant covering. The unfixed portions, i.e., those where marking has not taken place, can be washed off again thereafter.

This method is very rapid and reliable and produces a stable, clear mark on the respective surfaces.

To date, an analogous method for the marking of plastics surfaces has not existed.

It is an object of the present invention to provide an analogous or at least similar method for the marking of plastics surfaces and a corresponding composition which may be used for marking. A hurdle in the way of the present invention relative to the methods described in the prior art is that the temperature window within which plastics are in the melted state without undergoing decomposition is narrow.

We have found that this object is achieved by the method of the invention as claimed in claim 1 of the present invention and by the corresponding composition as claimed in claim 11 of the present invention. Further advantageous embodiments are specified in the subclaims.

Accordingly, the invention provides a method of marking a plastics surface, said method comprising at least the following steps:

a) applying a composition comprising at least one coloring component to a plastics surface, b) irradiating the plastics surface with light from a light source.

In one preferred embodiment, the light source is a laser, preferably a laser with a variably adjustable wavelength. In addition to a laser, however, all other suitable light sources are conceivable.

When a laser is used as the light source, its output, wavelength and write speed are determined as a function of the composition of the plastics surface and of the makeup of the composition. Owing to the narrow temperature window to be observed, it is necessary to operate with relatively low (local) energy, since otherwise there is a risk of decomposition of the plastics constituents. For this purpose, during the marking operation it is preferred not to pass over the target area once, as is conventional, but rather two or more times, possibly by moving the light source and/or the target surface backward and forward.

The primary aim of the above method is to fix the composition locally by means of radiation. For this purpose, at least part of the composition and/or part of the plastics surface must be fully or partly melted, after which a firm bond is formed between the locally fixed composition and the plastics surface.

The best bonds—i.e., the mechanically most solid bonds—between plastics surface and the composition are formed when during irradiation both components are liquefied and in this liquid state mix together at the molecular level at the interface, so that the phase boundaries virtually disappear. For this, however, the plastic of the plastics surface must be meltable and the temperature must be maintained until the phase boundary between composition and plastics surface has disappeared. Furthermore, the plastics fractions of the composition, where present, and the plastic of the substrate must be at least partly miscible with one another.

Accordingly, the composition comprising at least one coloring component preferably also comprises at least one plastics component. This component preferably comprises fine plastics particles. The plastics component may be selected arbitrarily from all meltable plastics which in the fully or partly melted state are highly mobile and possess film-forming properties. Depending on the surface which is to be provided with a marking, these plastics are selected freely from thermoplastics and thermosets. Particular plastics that may be mentioned include polyether urethanes and polyester urethanes, polyvinyl chloride, alkyd resins, phenolic resins, polyolefins, especially polyethylene homopolymers and copolymers, epoxy resins, polyesters, polystyrenes, styrene-acrylonitrile copolymers, polybutylene terephthalates, polyamides, and acrylic resins.

Also very suitable for use are the known powder coating or powder slurry systems, which comprise appropriate plastics and pigments in particle form, together if appropriate with a solvent.

Good adhesion is also produced when only the composition forms a film which adheres well to the unmelted plastics surface. Here too, the plastics fraction of the composition should be compatible with the plastics surface, should be able to wet this surface well in the melted state, and should subsequently adhere adequately.

It is also possible, however, to use a composition merely comprising as coloring component an organic or inorganic pigment and an appropriate solvent, such as THF, aliphatic or aromatic hydrocarbons, such as hexane, cyclohexane, toluene, etc.

The at least one coloring component of the composition is preferably temperature stable. For the purposes of the present invention, "temperature stable" means that its melting point is higher than the temperatures to which it is or may be exposed during implementation of the method of the invention. Coloring components which may be used include both organic and inorganic, temperature-stable pigments. Specific pigments that may be mentioned include naturally occurring inorganic pigments, such as chalk, ocher, umber, green earth, graphite, for example; synthetic inorganic pigments, such as white pigments, e.g., titanium dioxide, lead white, zinc white, lithopones, and antimony white, for example; black pigments, e.g., carbon blacks, black iron oxide, manganese black, and cobalt black, for example; color pigments, e.g., lead chromate, red lead oxide, zinc yellow, zinc green, cadmium red, cobalt blue, Prussian blue, ultramarine, manganese violet, cadmium yellow, Schweinfurt green, molybdate red and molybdate orange, chrome orange and chrome red, red iron oxide, chromium oxide green, and strontium yellow; and luster pigments, such as zinc powders or lead powders and pearluster pigments, for example, naturally occurring organic pigments, such as sepia brown, gamboge, bone charcoal, cassel brown, indigo, and chloropyl, for example; synthetic organic pigments, such as azo dyes, indigoids, phthalocyanines, those of the Heliogen type, isoindolinone pigments, perylene pigments and perinone pigments, for example; and also colored plastics, such as those, for example, composed of monomers which themselves in turn have a chromophoric group, and also mixtures of polymers with coloring substances. It is also possible to use what are known as composite pigments, i.e., $SiO_2$ particles with a colorant coating, for example. Further pigments suitable for use, and details on pigments in general, may be found in Ullmann, "Enzyklopädie der technischen Chemie", 4th edition, vol. 18, VCH-Verlag, Weinheim, and also Römpp's Chemielexikon, CD version 1.5, Georg Thieme Verlag 1998, in each case under the entry on Pigments, whose content in this respect is incorporated in its entirety by reference into the present specification.

Preferably, the at least one coloring component is dispersed uniformly in the at least one plastics component, it being possible for the latter in turn to be uncolored or colored itself.

Furthermore, the actual plastics component or the actual individual fine plastics particles may be chromophoric, i.e., connected firmly to the chromophoric component. This means that the plastics component is uniformly pigmented, as is the case with powder coating materials; in this case, the plastics component may be brought into the form of uniformly pigmented particles of appropriate size. The pigmented plastics particles preferably have an average diameter in a range from approximately 0.7 $\mu$m to approximately 15 $\mu$m, with particular preference from approximately 3 $\mu$m to approximately 10 $\mu$m. Powder coating materials of this kind generally comprise heat- and/or UV-curing powders. The polymer matrix used in this case may comprise thermosets, such as epoxy, polyester and acrylic resins, for example, and thermoplastics, such as polyacrylates, polyamides, ethylene-vinyl acetate copolymers, polyethylene homopolymers and copolymers, PVC, polyesters, and polyepoxides. Besides the polymer, the plastics component further comprises an appropriate crosslinker. Further information on the polymers and/or crosslinkers which may be used for powder coating may be found in the abovementioned literature reference "Ullmann", vol. 15, heading Coating materials, subheading Powder coating materials, whose content in this respect is incorporated in its entirety by reference into the present specification.

The pigmented plastics particles in powder form are then applied to the plastics surface that is to be marked. By irradiation with light, preferably with laser light, of appropriate wavelength, a firm bond of the applied powder with the target surface is produced.

In another preferred embodiment of the method of the invention, the composition comprising at least one chromophoric component is a mixture comprising uncolored plastics particles and homogeneous or composite colorant particles.

Furthermore, the composition comprising at least one chromophoric component may be a mixture comprising uncolored plastics particles and composite colorant particles in which primary pigment particles have been dispersed.

Preferably, the colorant particles are colored by means of soluble dyes. The average diameter of the colorant particles is preferably within a range from approximately 0.7 $\mu$m to approximately 15 $\mu$m, with particular preference within a range from approximately 3 $\mu$m to approximately 10 $\mu$m, more preferably still approximately 10 $\mu$m.

The average diameter of the uncolored plastics particles is preferably within a range from approximately 0.1 $\mu$m to approximately 15 $\mu$m, with particular preference approximately 3 $\mu$m. Preferably, these abovementioned mixtures, likewise in powder form, are applied to the plastics surface that is to be marked and are irradiated there with appropriate light.

In another preferred embodiment of the method of the invention, the composition comprising at least one chromophoric component is applied in the form of a suspension, i.e., in the manner of a paint, to the plastics surface that is to be marked. Various techniques may be used for applying the suspension to the target surface, preferably spraying and/or printing and/or knife coating and/or flow coating and/or by dipping of the surface that is to be marked into the suspension.

Preferably, the plastics particles used are produced by comminution, with particular preference by wet comminution.

In another preferred embodiment of the method of the invention, the plastics particles are produced by melt emulsification. This is a procedure in which, first of all, the plastic is melted, then brought into contact with a fluid with which it is not miscible, such as water, for example, in the course of which droplets of the plastic in the micrometer range are formed. Finally, the resulting mixture is cooled, producing a very finely particulate suspension with regular spherical plastics particles.

Furthermore, the plastics particles are preferably produced by polymerization.

In a further preferred embodiment of the method of the invention, the composition comprising at least one chromophoric component further comprises a crosslinking agent which is thermally and/or UV activatable. By means of these crosslinking agents, the plastics component is not only melted by irradiation and so bonded to the corresponding plastics surface but is also crosslinked with the surface at the same time, thus considerably improving the quality of the coating.

Suitable crosslinkers are likewise the widely known and widely used crosslinkers, such as polyisocyanates, isocyanurates, bisoxazolines, dicarboxylic acids, dicarboxylic anhydrides, epoxides, imidazolines and bisphenols, for example.

In this case, for example, first of all an uncrosslinked polymer, e.g., a thermoset, is produced as a particle covering or film on the plastics surface and then the crosslinking reaction is initiated, for example, thermally, for example, by raising the temperature to 100–200° C., but not to the melting temperature of the polymer, or by UV or electron beam irradiation. In addition, the polymer may also itself contain a group capable of crosslinking, e.g., a benzophenone group. Here again, the polymer is first of all applied as a particle covering or film to the plastics surface and the crosslinking reaction is initiated.

Where the polymer is initially in the form of a particle covering, it is possible during crosslinking to provide first for the formation of a (highly) liquid state in which a continuous film is formed from the disperse particle layer, and only then does curing (crosslinking) ensue.

The present invention further relates to the use of the method of the invention and, respectively, of the corresponding composition of the invention, comprising at least one chromophoric component, for marking plastics surfaces, and relates to said composition per se.

We claim:

1. A method of marking a plastic surface, said method comprising at least the following steps:

a) applying to a plastic surface a composition comprising at least one coloring component and at least one plastic component which comprises a crosslinking agent wherein the at least one coloring component is dispersed uniformly in the at least one plastic component, b) irradiating the plastic surface with light from a light source by passing over the plastic surface two or more times by moving the light source and/or the plastic surface backward and forward whereby the plastic component is melted and bonded to the plastic surface and crosslinked with the surface at the same time, wherein the light source is a laser.

2. A method as claimed in claim 1, wherein the at least one coloring component is temperature stable.

3. A method as claimed in claim 1, wherein the at least one plastics component comprises fine particles.

4. A method as claimed in claim 1, wherein the at least one plastics component is formed from uncolored plastics particles and the at least one coloring component is formed from homogenous or composite colorant particles.

5. A method as claimed in claim 1, wherein the composition comprising at least one coloring component is applied in powder form or as a suspension to the plastics surface.

6. A method of claim 1, wherein the crosslinking agent is thermally and /or UV-activatable.

7. A method of claim 1, wherein during irradiation the plastic surface and the plastic component are liquefied.

8. A method of claim 1, wherein the plastic component is selected from the group consisting of polyether urethanes and phenolic resins, polyolefins, epoxy resins, polyesters, polystyrenes, styrene-acrylonitriles copolymers, polybutene terephthalates, polyamides, and acrylic resins.

9. A method of claim 1, wherein the crosslinking agent is selected from the group consisting of polyisocyanates, isocyanurates, bisoxazolines, dicarboxylic acids, dicarboxylic anhydrides, epoxides, imidazolines and bisphenols.

10. A method of marking a plastic surface, said method comprises:

a) applying a composition comprising at least one coloring component and at least one plastic component which comprises a crosslinking agent wherein the at least one coloring component is dispersed uniformly in the least one plastic component, b) irradiating the plastic surface with light from a light source whereby the plastic component and the plastic surface are liquefied and the plastic component is bonded to the plastic surface and crosslinked with the surface at the same time.

11. A method as claimed in calm 10, wherein the light source is a laser.

* * * * *

UNITED STATES PATENT AND TRADEMARK OFFICE

CERTIFICATE OF CORRECTION

PATENT NO. : 6,592,949 B1
DATED : July 15, 2003
INVENTOR(S) : Polke et al.

It is certified that error appears in the above-identified patent and that said Letters Patent is hereby corrected as shown below:

Column 5,
Line 9, “plastics component” should be -- plastic component --;
Line 11, “plastics component” should be -- plastic component --.

Column 6,
Line 20, “calm 10” should be -- claim 10 --.

Signed and Sealed this

Fourteenth Day of October, 2003

JAMES E. ROGAN
*Director of the United States Patent and Trademark Office*